United States Patent [19]

Flick

[11] 4,087,237

[45] May 2, 1978

[54] METHOD AND APPARATUS FOR HEATING AN ELONGATED ARTICLE

[75] Inventor: Russell E. Flick, Greenville, S.C.

[73] Assignee: Phillips Petroleum Company, Bartlesville, Okla.

[21] Appl. No.: 684,983

[22] Filed: May 10, 1976

[51] Int. Cl.[2] ..... F27B 9/28

[52] U.S. Cl. ..... 432/8; 432/24; 432/55; 432/45

[58] Field of Search ..... 34/4; 432/8, 45, 55, 432/24, 12, 51

[56] References Cited

U.S. PATENT DOCUMENTS

| | | | |
|---|---|---|---|
| 2,991,989 | 7/1961 | Martin | 432/45 |
| 3,016,085 | 1/1962 | Gassner | 432/45 X |
| 3,052,281 | 9/1962 | Hilton | 156/359 |
| 3,162,430 | 12/1964 | Wilkerson | 432/45 |
| 3,994,073 | 11/1976 | Lackore | 34/4 |

*Primary Examiner*—John J. Camby

[57] ABSTRACT

An elongated article is heated in a heating zone positioned adjacent a conveying zone for conveying the elongated article by actuating the heating zone and controlling the temperature of the heating zone to a first temperature, then actuating the conveying zone after passage of a first period of time followed by controlling the temperature of the heating zone to a second temperature after the passage of a second period of time.

17 Claims, 4 Drawing Figures

METHOD AND APPARATUS FOR HEATING AN ELONGATED ARTICLE

BACKGROUND OF THE INVENTION

The invention relates to a method and apparatus for heating an elongated article. In another aspect the invention relates to a method and apparatus for fusing at least a portion of the synthetic filaments in a non-woven fabric by infrared radiation.

Frequently it is desirable to heat an elongated article. For example, a nonwoven fabric made from synthetic fibers, such as polypropylene fibers is often heated to fuse a portion of the fibers together in order to give the resulting fabric greater strength and dimensional stability. It has recently been found that fusing the filaments of a nonwoven fabric using infrared heaters provides an excellent product; however, it is difficult to start and stop such an infrared heating system without producing some fabric which is either fused too little or too much.

If a conveyor transporting the nonwoven fabric is started after the infrared heaters are energized, it is difficult to prevent the heat from overfusing or actually burning holes in the fabric. On the other hand, if the conveyor is started before the heaters are energized, then a segment of fabric is produced which is not adequately fused. Thus, there is a need for method apparatus for heating an elongated article, such as a nonwoven fabric of synthetic filaments using infrared heat, in which the heating system can be started and stopped without producing segments of the fabric which are subjected to an undesirable degree of heat.

It is an object of the invention to heat an elongated article.

Another object of the invention is to heat an elongated article using infrared heat.

Another object of the invention is to fuse together the filaments of a nonwoven fabric using infrared heat.

Another object of the invention is to start and stop an infrared heating system used for fusing together the filaments of a nonwoven fabric without producing some fabric which is either fused too little or too much.

SUMMARY

In accordance with the invention an elongated article is heated in a heating zone as the elongated article is conveyed in a conveying zone by first actuating the heating zone and controlling the temperature thereof to a first temperature by regulating the amount of energy supplied to the heating zone, then actuating the conveying zone after passage of a first period of time, followed by controlling the temperature of the heating zone to a second temperature after the passage of a second period of time by regulating the amount of energy supplied to the heating zone.

Further according to the invention an apparatus suitable for carrying out the above described method comprises a means for conveying an elongated article, a means for heating the elongated article as it is being conveyed, a control means for controlling the heating means, the control means being suitable for both actuating the conveying means and regulating the amount of energy supplied to the heating means in order to adjust the temperature of the heating means as a function of time.

In the practice of the invention the first heating zone is regulated to a first temperature which actually preheats the elongated article before the conveying zone is activated. After activation of the conveying zone the temperature of the heating zone is adjusted to a second temperature. Generally, it was found that the first temperature is substantially higher than the second temperature; however, there may be instances where the second temperature is the higher temperature. In the particular embodiment of the invention described in detail, heating elements 10, 12 and 14 which form a second heating zone are initially supplied with a low voltage and than a higher voltage to reduce the initial startup power requirements for the whole process.

Figure 1:
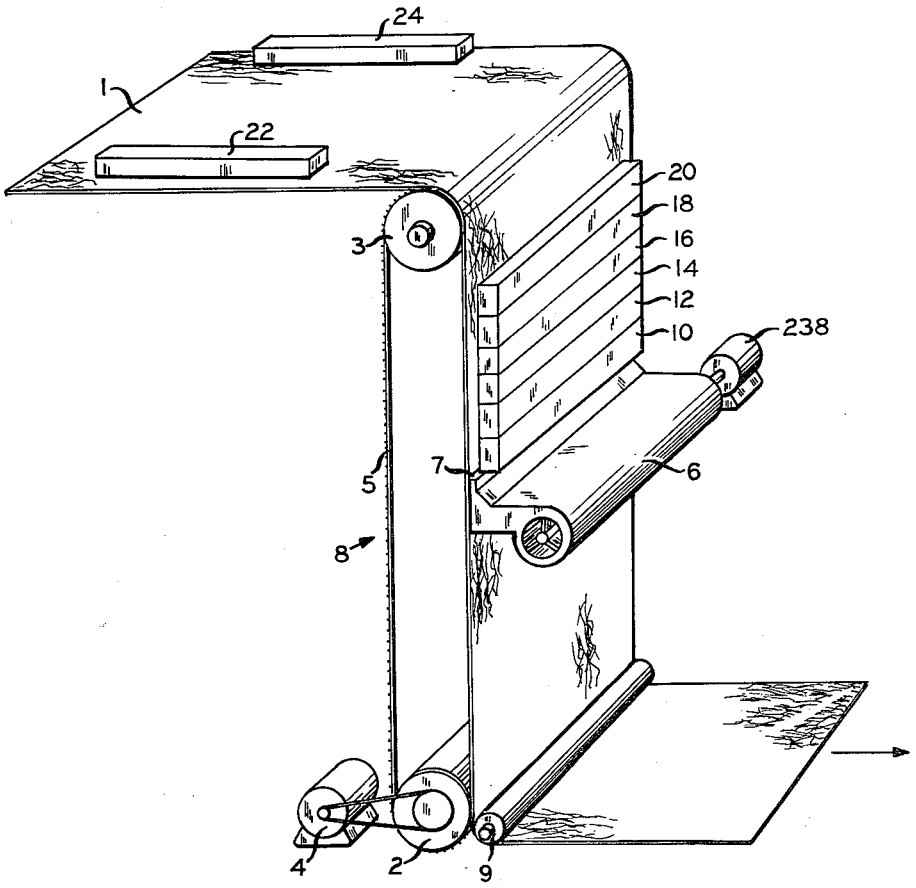
FIG. 1 illustrates one embodiment of an apparatus suitable for use for heating an elongated article in accordance with the invention.

Referring to FIG. 1, an elongated article 1, such as a nonwoven fabric well known in the art, is conveyed in the direction of the arrow on a conveying means, denoted generally by reference numeral 8 comprising rolls 2 and 3, belt 5 and power means 4. An example of such an apparatus is known as a tenter frame. As the fabric is released from the tenter frame it contacts roll 9. Also shown is a heating means having heating elements 22 and 24 each positioned with their longitudinal dimension parallel to an edge of the elongated article with one such element positioned along each edge. Six additional heating elements 10, 12, 14, 16, 18 and 20 are shown positioned with their longitudinal dimension transverse to the direction of movement of the elongated article. Each of these latter described heating elements have a lenght at least equal to the width of the elongated article. One example of the heating element suitable for use in the invention is an infrared heating element, such as a foil infrared heating element. The foil type infrared heating element has been used with good results and is presently preferred because of its ability to rapidly reach operating temperature when energized and also to rapidly cool down when de-energized to prevent damage to the elongated article. For example in one instance, heaters 10, 12, 14, 16, 18 and 20 were Leeco speed foil, Model 2-224-A, and heaters 22 and 24 were Model 7-24-52S manufactured by Joyal Industries, Inc., Coventry, R.I. The heating elements are generally positioned adjacent the elongated article a distance ranging from about 2 to about 24 inches depending upon the specific type of heating element employed, the heating capacity of each heating element, the number of heating elements used, the type of elongated article heated, etc. As an example, when heating a nonwoven fabric comprising polypropylene staple filaments and weighing 1.7 oz./yd.$^2$ employing the apparatus shown in FIG. 1 in which each heating element has a rated heating capacity of 66,938 Btu/hr., in order to fuse a portion of the filaments, the heating elements were positioned 3¼ inches from the surface of the fabric. The staple was approximately 3¼ inches long and a denier of approximately 3.

FIG. 1 also shows a cooling means 6 having a power means 238. The outlet 7 of the cooling means 6 is positioned adjacent heating element 10 and the elongated article so that upon being actuated it will provide a stream of air between the elongated article and heating elements 10, 12, 14, 16, 18 and 20. If desired, heating elements 22 and 24 could be located in the vertical plane such as for example with the ends of heating elements 22 and 24 adjacent heating element 20; however, such relocation of heating elements 22 and 24 has not been necessary in order to properly fuse the polypropylene nonwoven fabric described above.

Figure 2A:
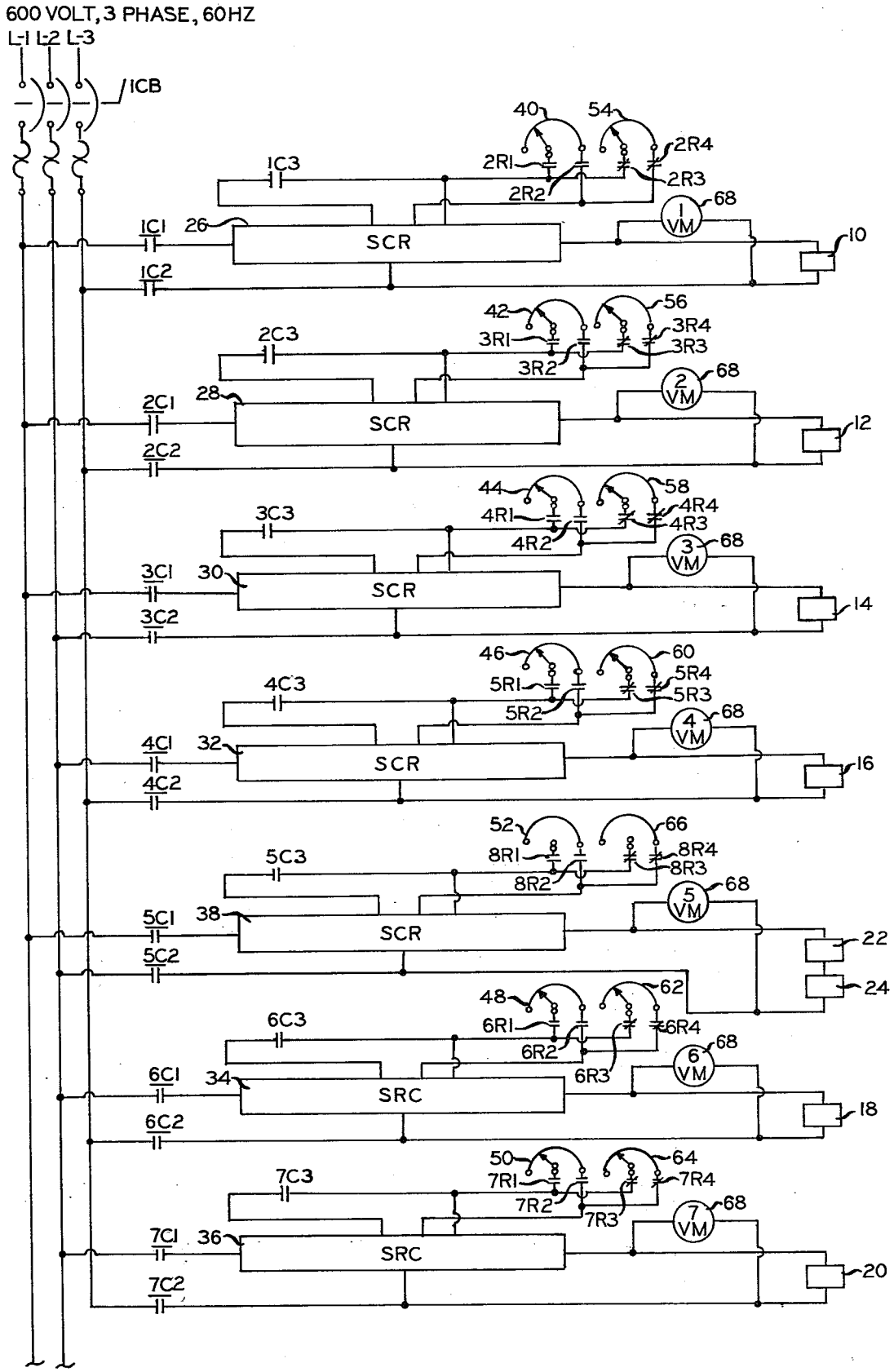
FIGS. 2A, 2B and 2C are a schematic wiring diagram of a control circuit suitable for use in an embodiment of the method of the invention and for use with the embodiment of the apparatus of the invention shown in FIG. 1.
Figure 2B:
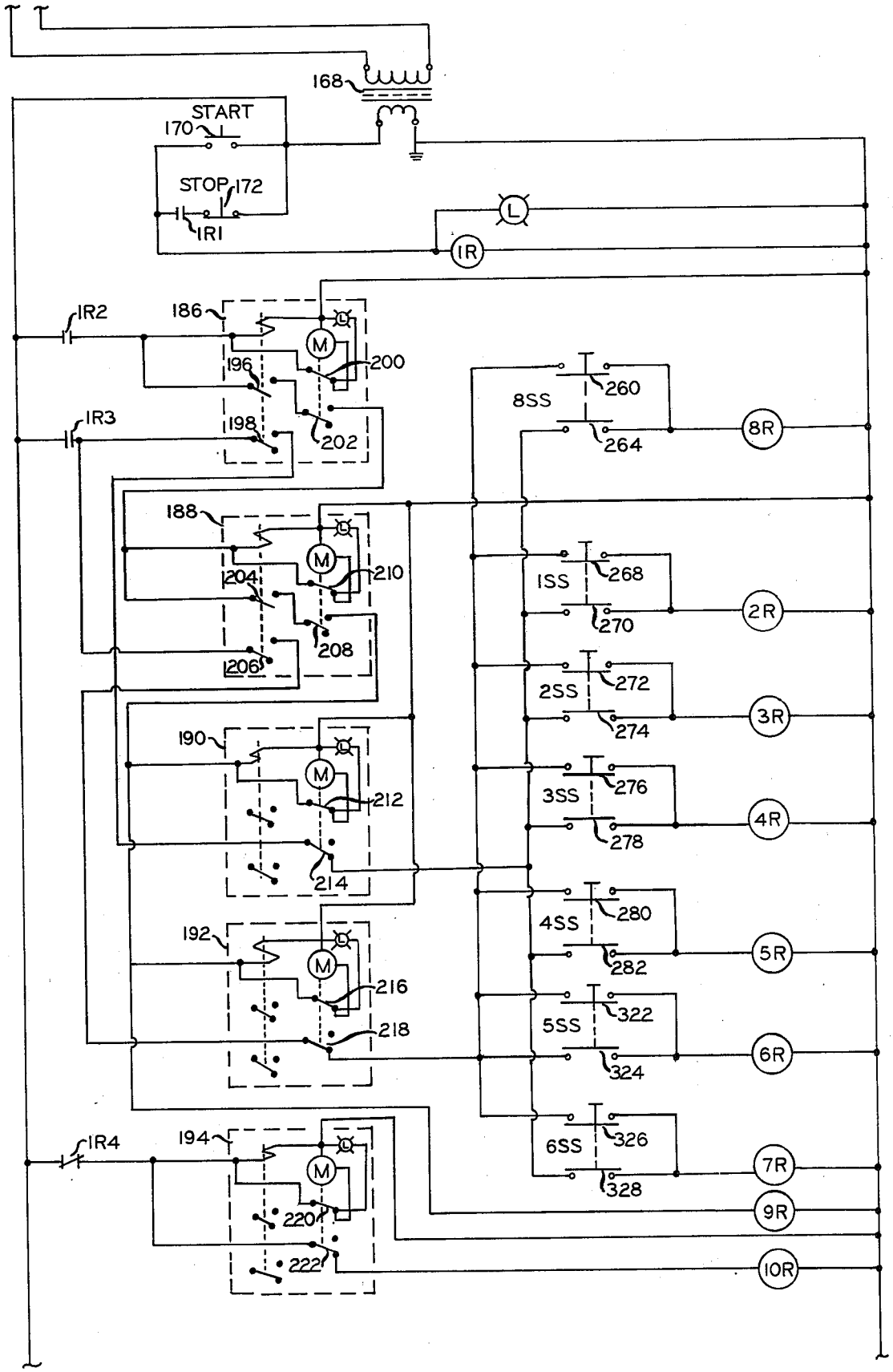
Figure 2C:
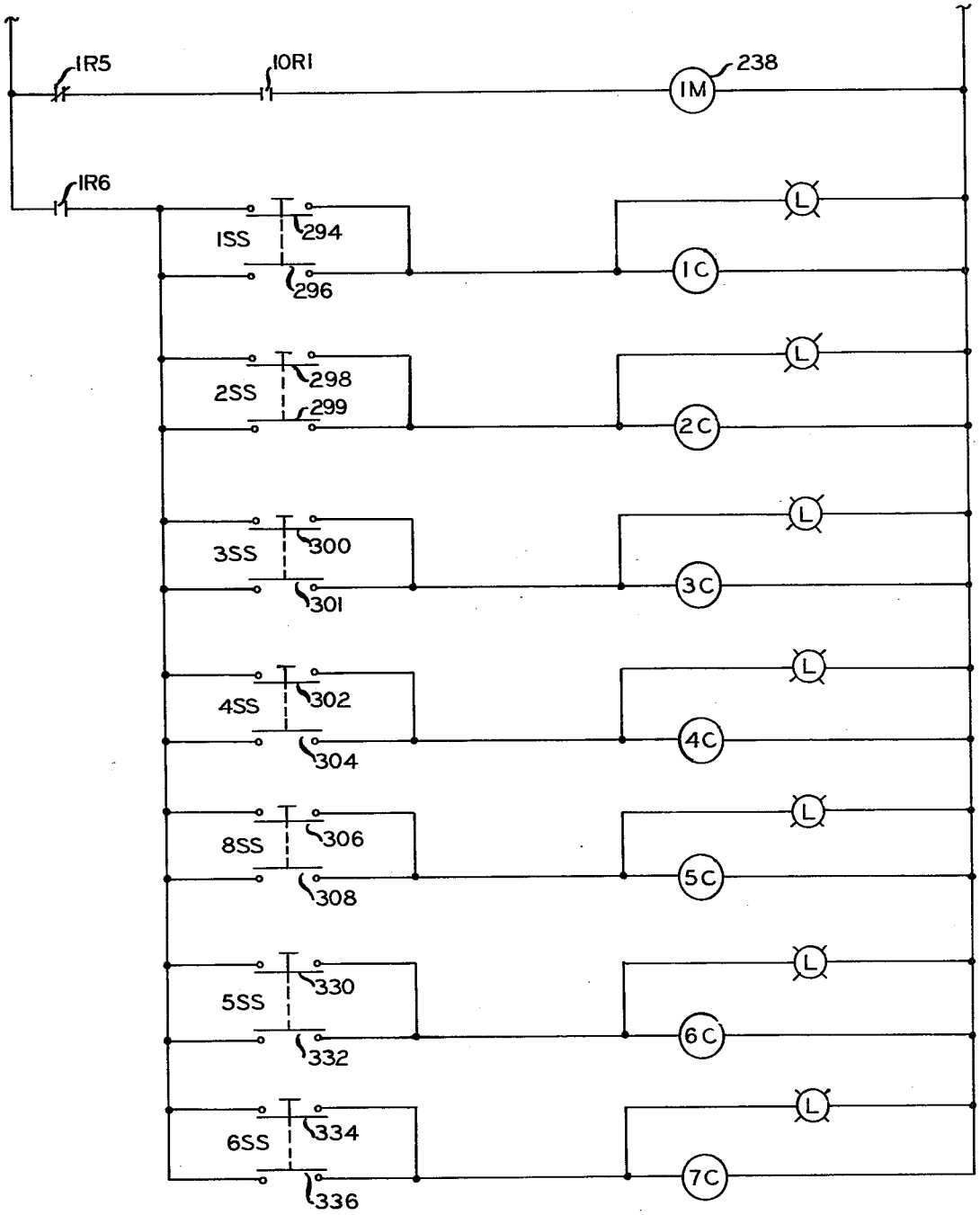

The schematic wiring diagram of FIGS. 2A, 2B and 2C is designed for use with the eight heating elements 10, 12, 14, 16, 18, 20, 22 and 24 shown in FIG. 1 wherein a first heating means comprises heating elements 16, 18 and 20; a second heating means comprises heating elements 10, 12 and 14; and a third heating means comprises heating elements 22 and 24. It is emphasized that any desired number of heating elements can be employed with limited modification of the schematic wiring diagram shown in FIGS. 2A, 2B and 2C, such modification being well within the capability of those skilled in the art. Further, the specific groupings of the heating elements of the first and second heating means can be adjusted simply by the use of selector switches 155 to 655 and 855. The actual voltage applied to each heating element of the first and second heating means can be independently regulated through the use of potentiometers as hereinafter described. Heating elements 22 and 24 of the third heating means are wired in series and both elements are regulated together. Two separate and independent voltages are preset for each of the heating elements 10, 12, 14, 16, 18 and 20 and the third heating means comprising heating elements 22 and 24. The control of the apparatus of FIG. 1 by the electrical system of FIGS. 2A, 2B and 2C provides for initially starting up the apparatus of FIG. 1 and shutting down the apparatus without producing some of the elongated article which has been either heated too little or too much.

In FIGS. 2A, 2B and 2C there is shown a suitable power supply, such as for example a 600 volt, 3 phase, 60 Hz power supply connected to the control system through leads L-1, L-2, L-3 and circuit breaker 1CB. The 600 volts are reduced to a suitable control voltage via transformer 168. Controls 26, 28, 30, 32, 34 and 36 provide for presetting two separate voltages for the heating elements. Such controls known in the art are silicon controlled full wave rectifiers, SCR's, each having two adjustable independent load potentiometers 40, 54; 42, 56; 44, 58; 46, 60; 52, 66; 48, 62; and 50, 64 for SCR's 26, 28, 30, 32, 38, 34 and 36, respectively. For example in one instance, controls 26, 28, 30, 32, 34 and 36 were Payne Engineering, South Charleston, W. Va., silicon control rectifiers, Model 18D-5-4, and control 38 was Model 18D-5-20. Heating elements 10, 12, 14, 16, 18 and 20 previously described are wired to SCR controls 26, 28, 30, 32, 34 and 36, respectively. Heating elements 22 and 24 are wired in series to SCR control 38. Each silicon controlled rectifier has an indicating volt meter 68. Also shown in FIGS. 2B and 2C is three-position selector switch 8SS which either makes contacts 260 and 306 or 264 and 308 or is in the off position. Switches 1SS, 2SS, 3SS, 4SS, 5SS and 6SS are identical to switch 8SS except of course they operate different contacts. When switch 1SS is in the off position none of the contacts are made, when the switch is in the up position contacts 268 and 294 are made, and when the switch is in the down position contacts 270 and 296 are made. For switch 2SS contacts 272 and 298 are made in the up position or contacts 274 and 299 are made in the down position. For switch 3SS, contacts 276 and 300 are made in the up position or contacts 278 and 301 are made in the down position; for switch 4SS, contacts 280 and 302 are made in the up position or contacts 282 and 304 are made in the down position; for switch 5SS, contacts 322 and 330 are made in the up position or contacts 324 and 332 in the down position; and for switch 6SS, contacts 326 and 334 are made in the up position or contacts 328 and 336 are made in the down position. For all of these switches, none of the contacts are made in the off position. Also shown are five timers, 186, 188, 190, 192, and 194. Each timer possesses a pair of instantaneous contacts and a pair of delayed contacts, although not all of the contacts are employed in the embodiment shown in the drawings. All of the timers are wired so that the instantaneous contacts are actuated upon energization of the timer and the delayed contacts are actuated according to the length of time preset on each timer. For example in one instance, the timers were Eagle Signal Cycl-Flex reset timers, a Division of Gulf and Western Industries, Inc., Davenport, Iowa. Such timers are well known in the art and no further description is deemed necessary. Prior to the operation of the control system as shown in FIGS. 2A, 2B and 2C as used with the apparatus of FIG. 1, selector switches 1SS, 2SS and 3SS are normally set in the upper position closing contacts 268 and 294, 272 and 298, and 276 and 300, respectively. Selector switches 4SS, 5SS, 6SS and 8SS are set in the lower position closing contacts 282 and 304, 324 and 332, 328 and 336, and 264 and 308, respectively. The above-described switch positions change the potentiometers controlling heating elements 16, 18, 20, 22 and 24 at the same time effectively grouping these three heating elements as a single heating means. Similarly the potentiometers controlling heating elements 10, 12 and 14 are changed at the same time effectively grouping these three heating elements as a single heating means. Heating elements 22 and 24 as previously described are wired in series to SCR 38 and accordingly each heating element sees the same potentiometer. With the exception of heating elements 22 and 24, the voltage applied to each heating element is independently controlled by their respective potentiometers.

In one particular embodiment of the invention in which a nonwoven polypropylene fabric weighing 1.7 ounces per square yard was fused using the apparatus of FIG. 1 as controlled by the control system of FIGS. 2A, 2B and 2C with a line speed of 42.5 feet per minute, potentiometers 40, 42 and 44 were adjusted to 440 volts for control of heaters 10, 12 and 14, respectively, and potentiometers 46, 48 and 50 were adjusted for 240 volts, 280 volts and 260 volts to control heating elements 16, 18 and 20, respectively. Potentiometer 52 was adjusted to 110 volts to control heating elements 22 and 24. Potentiometers 54, 56 and 58 were adjusted for 235 volts, 229 volts and 231 volts for heaters 10, 12 and 14, respectively, and potentiometers 60, 62 and 64 were adjusted for 318 volts, 345 volts and 320 volts for heaters 16, 18 and 20, respectively. Potentiometer 66 controlling heaters 22 and 24 was adjusted for 238 volts. It is noted again that each heating element is controlled by one of two separate potentiometers, except heating elements 22 and 24 which are both controlled by one of two potentiometers. The selection of the potentiometer to control the heating elements is hereinafter described.

To start the apparatus of FIG. 1 employing the control system of FIGS. 2A, 2B and 2C, start button is pushed momentarily closing contacts 170. This energizes relay 1R which closes contacts 1R1, 1R2, 1R3 and 1R6 and opens contacts 1R4 and 1R5. The closure of contact 1R6 applies a signal to the coils of relays 1C, 2C, 3C, 4C, 5C, 6C and 7C indicated by their respective indicating lights R because each of selector switches 1SS to 6SS and 8SS are either in the up or the down position as previously described.

The closure of contact 1R2 actuates timer 186 to start the timing for actuation of delayed contacts 200 and 202 and immediately actuates instantaneous contacts 196 and 198. Timer 186 in this particular embodiment is set on 4 seconds. The closure of contacts 184 and 198 applies a signal through the delayed contacts 214 of timer 190 through contacts 264, 282, 324, and 338 to actuate relays 8R, 5R, 6R and 7R, respectively. Relay 8R opens contacts 8R3 and 8R4 and closes contacts 8R1 and 8R2. Relay 5R opens contacts 5R3 and 5R4 and closes contacts 5R1 and 5R2. Relay 6R opens contacts 6R3 and 6R4 and closes contacts 6R1 and 6R2. Relay 7R opens contacts 7R3 and 7R4 and closes contacts 7R1 and 7R2.

The closure of contacts 1C1, 1C2 and 1C3 energizes SCR 26 which applies the voltage of 235 volts on potentiometer 54 to heater 10; the closure of contacts 2C1, 2C2 and 2C3 energizes SCR 28 which applies a voltage of 229 volts set on potentiometer 56 to heater 12; the closure of 3C1, 3C2 and 3C3 energizes SCR 30 which applies 231 volts set on potentiometer 58 to heater 14; the closure of contacts 4C1, 4C2 and 4C3 energizes SCR 32 and with the closure of contacts 5R1 and 5R2 applies 240 volts set on potentiometer 46 to heater 16; the closure of contacts 6C1, 6C2 and 6C3 energizes SCR 34 and with the closure of contacts 6R1 and 6R2 applies 280 volts set on potentiometer 48 to heater 18; the closure of contacts 7C1, 7C2 and 7C3 energizes SCR 36 and with the closure of contacts 7R1 and 7R2 applies 260 volts set on potentiometer 50 to heating element 20; and the closure of contacts 5C1, 5C2 and 5C3 energizes SCR 38 and with the closure of contacts 8R1 and 8R2 applies 110 volts to set on potentiometer 52 to heating elements 22 and 24.

After 4 seconds times out on timer 186 a signal is applied through instantaneous contacts 196 and delayed contacts 202 to apply a signal to actuate timer 188 which in this embodiment is set for a time of 1 second. The instantaneous contacts 204 and 206 of timer 188 are actuated applying a signal through contacts 184 and 206 through delayed contacts 218 of timer 192 through contacts 268, 272 and 276 to actuate relays 2R, 3R and 4R, respectively. Relay 2R opens contacts 2R3 and 2R4 and closes contacts 2R1 and 2R2. Relay 3R opens contacts 3R3 and 3R4 and closes contacts 3R1 and 3R2. Relay 4R opens contacts 4R3 and 4R4 and closes contacts 4R1 and 4R2.

With the closing of contacts 2R1 and 2R2 and the opening of contacts 2R3 and 2R4, 440 volts set on potentiometer 40 is applied to heater 10; with the closing of contacts 3R1 and 3R2 and the opening of contacts 3R3 and 3R4, 440 volts set on potentiometer 42 is applied to heater 12; and the closing of contacts 4R1 and 4R2 and the opening of contacts 4R3 and 4R4, applies 440 volts set on potentiometer 44 to heater 14.

After the lapse of time set on timer 188, and in this instance 1 second, the closure of contacts 208 applies a signal to timers 190 and 192 and actuates relay 9R which in turn actuates the motor starter (not shown) for power means 4. The instantaneous contacts for timers 190 and 192 are not utilized. When the delayed contacts of timer 190 and specifically contacts 214 are actuated after the time set on timer 190 lapses, which in this instance is 1 second, the signal applied to relays 8R, 5R, 6R and 7R is removed. This in turn opens contacts 8R1 and 8R2 and closes contacts 8R3 and 8R4, opens contacts 5R1 and 5R2 and closes contacts 5R3 and 5R4, opens contacts 6R1 and 6R2 and closes contacts 6R3 and 6R4, and opens contacts 7R1 and 7R2 and closes contacts 7R3 and 7R4. With the closing of contacts 5R3 and 5R4 and the opening of contacts 5R1 and 5R2, 318 volts adjusted on potentiometer 60 is applied to heating element 16. With the closing of contacts 8R3 and 8R4 and opening of contacts 8R1 and 8R2, 238 volts set on potentiometer 66 is applied to heating elements 22 and 24. With the closing of contacts 6R3 and 6R4 and the opening of contacts 6R1 and 6R3, 345 volts set on potentiometer 62 is applied to heating element 18. With the closing of contacts 7R3 and 7R4 and the opening of contacts 7R1 and 7R2, 320 volts set on potentiometer 64 is applied to heating element 20.

Then when timer 192 times out, in this embodiment 11 seconds, and actuates the delayed contacts 218, the signal applied through contacts 218 to relays 2R, 3R and 4R is removed. Deactuation of relay 2R closes contacts 2R3 and 2R4 and opens contacts 2R1 and 2R2 applying 235 volts set on potentiometer 54 to heating element 10. Deactuation of relay 3R closes contacts 3R3 and 3R4 and opens contacts 3R1 and 3R2 applying 229 volts set on potentiometer 56 to heating element 12. The actuation of relay 4R closes contacts 4R3 and 4R4 and opens contacts 4R1 and 4R2 applying 231 volts set on potentiometer 58 to heating element 14.

At this point the apparatus shown in FIG. 1 is in a stable operating condition and the voltages now applied to the heating elements remain unchanged until the stop button is pushed which breaks contacts 172. When contacts 172 are broken the signal to relay 1R is removed which opens contacts 1R1, 1R2, 1R3 and 1R6 and closes contacts 1R4 and 1R5. When contacts 1R6 are opened the signal to relays 1C, 2C, 3C, 4C, 5C, 6C and 7C is removed, opening contacts 1C1, 1C2, 1C3, 2C1, 2C2, 2C3, 3C1, 3C2, 3C3, 4C1, 4C2, 4C3, 5C1, 5C2, 5C3, 6C1, 6C2, 6C3, 7C1, 7C2 and 7C3, which deactivates SCR's 26, 28, 30, 32, 34, 36, and 38 which in turn removes the voltages applied to heating elements 10, 12, 14, 16, 18, 20, 22, and 24. The closing of contacts 1R4 applies a signal to timer 194 to begin its timing cycle. In this particular embodiment, timer 194 is preset for 49 seconds. A signal through the delayed contacts 222 which are normally closed is applied to relay 10R. Relay 10R closes contacts 10R1 and a signal is applied through contacts 1R5 and 10R1 to energize the power means 238 of the cooling means until timer 194 times out moving the signal from relay 10R opening contacts 10R1, and removing the signal to power means 238 which turns off the cooling means. In addition pushing the stop button removes the signal from relay 9R which immediately turns off the signal to conveyor power means 4.

A summary of the above-described operating conditions of the apparatus disclosed in FIG. 1 as controlled by the control system shown in FIGS. 2A, 2B and 2C is illustrated below in Table I.

Table I

| | | Operating Conditions | | | | | | | | |
|---|---|---|---|---|---|---|---|---|---|---|
| | | Heating Element Voltage | | | | | | | | Cooling |
| | Time | 10 | 12 | 14 | 16 | 18 | 20 | 22/24 | Conveyor | Means |
| | 0 | 0 | 0 | 0 | 0 | 0 | 0 | 0 | Off | Off |
| | Push Start | 235 | 229 | 231 | 240 | 280 | 260 | 110 | Off | Off |
| Seconds After Start | 4 | 440 | 440 | 440 | 240 | 280 | 260 | 110 | Off | Off |
| | 5 | 440 | 440 | 440 | 240 | 280 | 260 | 110 | On | Off |
| | 6 | 440 | 440 | 440 | 318 | 345 | 320 | 238 | On | Off |
| | 17 | 235 | 229 | 231 | 318 | 345 | 320 | 238 | On | Off |
| | Push Stop | 0 | 0 | 0 | 0 | 0 | 0 | 0 | Off | On |
| Seconds After Stop | 49 | 0 | 0 | 0 | 0 | 0 | 0 | 0 | Off | Off |

The above description of the invention with respect to the specific voltages applied to the heating elements, the number of heating elements and groupings thereof, the times set on the timers, etc., are not intended as limitations on the present invention, but they were provided for purposes of illustration only. As previously described the values for the parameters of Table I were found to provide good results for fusing a 1.7 ounce per squae yard nonwoven polypropylene fabric conveyed at 42.5 feet per minute wherein the polypropylene staple had a staple length of approximately 3¼ inches and a denier of approximately 3. Changes in fabric weight, staple length, denier, or material, line speed, degree of fusion desired, etc., are all parameters which could change the variable values shown in Table I. Also if the fabric is subjected to heating elements on one or both sides of the fabric is a consideration which could alter the values shown in Table I; however, it has been found that fusing the staple of a nonwoven fabric using infrared radiation on only one side of the fabric results in fused staple being produced completely through the entire thickness of the fabric by properly adjusting the heating elements.

That which is claimed is:

1. Apparatus comprising:

means for conveying an elongated article;

first heating means for heating the elongated article as it is being conveyed;

first control means for controlling the first heating means, said control means being for regulating the amount of energy supplied to said first heating means in order to adjust the temperature of the first heating mean to a first temperature upon actuation of said first control means, then after the passage of a first period of time for actuating the conveying means and after the passage of a second period of time for regulating the amount of energy supplied to said first heating means in order to adjust the temperature of the first heating means to a second temperature.

2. The apparatus of claim 1 further comprising a second heating means for heating the elongated article as it is being conveyed and a second control means for controlling the second heating means, said second control means being for regulating the amount of energy supplied to said second heating means in order to adjust the temperature of the second heating means to a first temperature upon actuation of said second control means, then after the passage of a third period of time for regulating the amount of energy supplied to said second heating means in order to adjust the temperature of the second heating means to a second temperature, and then after the passage of a fourth period of time for regulating the amount of energy supplied to said second heating means in order to regulate the temperature of said second heating means to a third temperature.

3. The apparatus of claim 2 further comprising a third heating means for heating the elongated article as it is being conveyed and a third control means for controlling the third heating means, said third control means being suitable for regulating the amount of energy supplied to said third heating means in order to adjust the temperature of the third heating means to a first temperature upon actuation of said third control means, then after the passage of a fifth period of time to regulate the amount of energy supplied to said third heating means in order to adjust the temperature of the third heating means to a second temperature.

4. The apparatus of claim 1 further comprising a cooling means positioned adjacent the elongated article for providing a stream of air between said elongated article and the heating means and a fourth control means suitable for energizing said cooling means upon deactuation of said conveying means.

5. The apparatus of claim 3 wherein said first, second and third heating means are infrared heaters and the actuation of the conveying means, regulation of the first heating means, the second heating means and the third heating means to the second temperature, and regulation of the second heating means to the third temperature are automatically performed.

6. The apparatus of claim 3 wherein said first heating means comprises an infrared heater having three separate heating elements, each of said elements having a separate control means, wherein said second heating means comprises an infrared heater having three separate heating elements of said second heating means, each of said elements having a separate control means, and wherein said third heating means comprises an infrared heater having two separate heating elements both being controlled by the same control means.

7. The apparatus of claim 6 wherein the lengthwise dimension of the heating elements of said first and second heating means is positioned transverse to the direction the elongated article is conveyed and the lengthwise dimension of each of the two heating elements of said third heating means is positioned with the lengthwise dimension parallel to an edge of the elongated article with one such element positioned along each edge.

8. The apparatus of claim 7 wherein the heating elements of said first, second and third heating means are positioned from the surface of the elongated article a distance ranging from about 2 to about 24 inches.

9. The apparatus of claim 8 wherein the elongated article is a nonwoven fabric and the first and second heating means each comprise three heating elements.

10. The apparatus of claim 9 wherein the nonwoven fabric comprises polypropylene staple.

11. A method comprising:

actuating a first heating one, said heating zone being positioned adjacent a conveying zone for heating an elongated article conveyed in said conveying zone;

controlling the temperature of said first heating zone to a first temperature by regulating the amount of energy supplied to said first heating zone;

actuating the conveying zone after the passage of a first period of time; and controlling the temperature of said first heating zone to a second temperature after the passage of a second period of time by regulating the amount of energy supplied to said first heating zone.

12. The method of claim 11 further comprising actuating a second heating zone when actuating said first heating zone, said second heating zone being positioned adjacent said first heating zone and said conveying zone for heating the elongated article conveyed in said conveying zone;

controlling the temperature of said second heating zone to a first temperature by regulating the amount of energy supplied to said second heating zone;

controlling the temperature of said second heating zone to a second temperature after the passage of a third period of time by regulating the amount of energy supplied to said second heating zone; and automatically controlling the temperature of said second heating zone to a third temperature after the passage of a fourth period of time by regulating the amount of energy supplied to said second heating zone.

13. The method of claim 12 further comprising actuating a third heating zone when actuating said first and second heating zones, said third heating zone being positioned adjacent said conveying zone for heating the elongated article conveyed in said conveying zone, controlling the temperature of said third heating zone to a first temperature upon acutation of said third heating zone by regulating the amount of energy supplied to said third heating zone, controlling the temperature of said third heating zone to a second temperature after the passage of a firth period of time.

14. The method of claim 12 wherein the actuation of the conveying zone; controlling of the first heating zone, second heating zone and third heating zone to the second temperature; and controlling of the second heating zone to the third temperature are automatically performed.

15. The method of claim 13 further comprising providing a flow of air between said elongated article and at least said first and second heating zones upon deactuation of said conveying zone.

16. The method of claim 13 wherein the elongated article is a nonwoven fabric comprising synthetic filaments, wherein said first, second and third heating zones are infrared heating zones and wherein at least a portion of the synthetic filaments in the nonwoven fabric are fused together in said infrared heating zones.

17. The method of claim 16 wherein the synthetic filaments in the nonwoven fabric are polypropylene staple.

* * * * *

UNITED STATES PATENT AND TRADEMARK OFFICE

CERTIFICATE OF CORRECTION

PATENT NO. : 4,087,237

DATED : May 2, 1978

INVENTOR(S) : Russell E. Flick

It is certified that error appears in the above-identified patent and that said Letters Patent are hereby corrected as shown below:

Column 7, line 48, "mean" should read --- means ---.
Column 8, line 51, after "ments" insert ---, each of said elements ---; lines 51 and 52, after "means" delete ", each of said elements".
Column 9, line 7, after "heating", "one" should read --- zone ---; line 7, after "said" insert --- first ---.
Column 10, line 14, "firth" should read --- fifth ---.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*